US009941564B2

(12) United States Patent
Kang et al.

(10) Patent No.: US 9,941,564 B2
(45) Date of Patent: Apr. 10, 2018

(54) DIELECTRIC RESONATOR, ASSEMBLY METHOD THEREFOR, AND DIELECTRIC FILTER

(71) Applicant: ZTE CORPORATION, Shenzhen, Guangdong Province (CN)

(72) Inventors: Yulong Kang, Shenzhen (CN); Wanli Yu, Shenzhen (CN); Xiaowen Dai, Shenzhen (CN)

(73) Assignee: ZTE Corporation, Shenzhen, Guangdong Province (CN)

( * ) Notice: Subject to any disclaimer, the term of this patent is extended or adjusted under 35 U.S.C. 154(b) by 130 days.

(21) Appl. No.: 14/650,911

(22) PCT Filed: Sep. 18, 2013

(86) PCT No.: PCT/CN2013/083714
§ 371 (c)(1),
(2) Date: Jun. 10, 2015

(87) PCT Pub. No.: WO2014/090004
PCT Pub. Date: Jun. 19, 2014

(65) Prior Publication Data

US 2015/0364807 A1 Dec. 17, 2015

(30) Foreign Application Priority Data

Dec. 10, 2012 (CN) ..... 2012 1 0528159

(51) Int. Cl.
*H01P 1/208* (2006.01)
*H01P 7/10* (2006.01)
*H01P 11/00* (2006.01)

(52) U.S. Cl.
CPC ..... *H01P 1/2084* (2013.01); *H01P 7/10* (2013.01); *H01P 11/008* (2013.01); *Y10T 29/49018* (2015.01)

(58) Field of Classification Search
CPC ..... H01P 7/10; H01P 1/2048; H01P 1/2084; H01P 11/008; Y10T 29/49018
(Continued)

(56) References Cited

U.S. PATENT DOCUMENTS 4,639,699 A * 1/1987 Nishikawa ..... H01P 7/10 333/202
5,874,871 A * 2/1999 Didriksen ..... H01P 7/10 333/202
6,002,311 A 12/1999 Wey et al.

FOREIGN PATENT DOCUMENTS

CN 101895004 A 11/2010
CN 201749933 U 2/2011
(Continued)

OTHER PUBLICATIONS

Low-Loss Bandpass Filter Using Dielectric Rod Resonators Oriented Axially in a High-Tc Superconductor Cylinder; Y. Kogami et al.Japan; Jun. 10-14, 1991.
(Continued)

*Primary Examiner* — Benny Lee
*Assistant Examiner* — Hafizur Rahman
(74) *Attorney, Agent, or Firm* — Ling Wu; Stephen Yang; Ling and Yang Intellectual Property

(57) ABSTRACT

A dielectric resonator includes: two dielectric resonant cylinders and a metal cavity, wherein the dielectric resonant cylinders are located within the metal cavity; and it also includes: a fastener and a connector, wherein bottoms of the dielectric resonant cylinders are connected via the connector to form a U-shaped structure, and the connector is fixed on the metal cavity via the fastener. With the dielectric resonator of the embodiments of the present invention, a good close contact between the dielectric resonant cylinders and the metal cavity can be guaranteed, thereby improving the resonant performance of the dielectric resonator.

16 Claims, 4 Drawing Sheets

(58) Field of Classification Search
USPC ..... 333/212
See application file for complete search history.

(56) References Cited

FOREIGN PATENT DOCUMENTS

| | | | | |
|---|---|---|---|---|
| CN | 201804986 | U | 4/2011 | |
| CN | 102044730 | A | 5/2011 | |
| CN | 102569978 | A | 7/2012 | |
| CN | 103050760 | A | 4/2013 | |
| EP | 0197653 | A2 | 10/1986 | |
| EP | 0693628 | A1 | 1/1996 | |
| EP | 0790661 | A2 | 8/1997 | |
| EP | 0964473 | A1 | 12/1999 | |
| JP | S5963801 | A | 4/1984 | |
| JP | 2010199790 | A | 9/2010 | |
| JP | 2012205103 | A | 10/2012 | |
| WO | WO2010013982 | A2 | 2/2010 | |
| WO | WO 2011113279 | A1 * | 9/2011 | ..... H01P 1/2084 |

OTHER PUBLICATIONS

Database WPI; Thomson Scientific, London, GB; AN 2012-N41293; XP002748612; Kyocera Corp; Oct. 22, 2012.
Database WPI; Thomson Scientific, London, GB; AN 2012-A81390; XP002748613; Whuan Fanguelectronic Technology Co Ltd; May 4, 2011.

* cited by examiner

DIELECTRIC RESONATOR, ASSEMBLY METHOD THEREFOR, AND DIELECTRIC FILTER

TECHNICAL FIELD

The present document relates to the field of communication, and more specifically, to a dielectric resonator and an assembly method thereof and a dielectric filter.

BACKGROUND OF THE RELATED ART

When an electromagnetic wave is propagated in high dielectric constant substances, a wavelength of the electromagnetic wave will be shortened, by using this characteristic, the traditional metal materials can be replaced with dielectric materials (such as ceramics), under the same index, a volume of the filter can be lessened. The research on the dielectric filter is always a hotspot in the communications industry. Since the filter serves as a major component of wireless communication products, the dielectric filter plays a particularly important role in the miniaturization of the communication products.

Generally, the dielectric filter is mainly composed of dielectric resonant cylinders 103, a sealing cover plate 102, a tuning screw 101 and a metal cavity 104, with reference to FIG. 1.

According to a working principle of a TM mode dielectric resonant cavity, when a dielectric resonator normally operates, high electric-field distribution exists in a binding site between lower end faces of the cylindrical dielectric resonant cylinders 103 and the metal cavity 104. If the contact between the lower end faces of the dielectric resonant cylinders and the metal cavity 104 is insufficient, discontinuous impedance will be caused, field energy cannot be transmitted out, a high dielectric constant and high quality factor of the medium cannot be brought into play, and even the medium will be burn up. Therefore, whether the contact between the lower surfaces of the dielectric resonant cylinders and the surface of the metal cavity is good in a TM mode dielectric filter is especially crucial. How to solve the fixation and contact of the TM mode dielectric resonant cylinders becomes a key research direction of the dielectric filter application.

With reference to FIG. 1, lower end faces of two nonmetal dielectric resonant cylinders whose lower ends are coated with a metal layer (such as ceramics) or lower end faces of metal resonant cylinders 103 are directly welded on the metal cavity 104, which is used for close contact with the undersurface of the metal cavity. The sealing cover plate 102 seals the metal cavity 104 through the screw, to form a hermetic cavity. Since directly welding the dielectric resonant cylinders on the undersurface of the metal cavity has extremely high requirements for welding technology, there is a shedding phenomenon in the entire dielectric resonant cylinder welding process, which severely affects the performance and service life of the dielectric filter.

A TM mode dielectric filter in the related art includes a metal resonant cavity, a cover plate, a tuning screw and a TM mode dielectric resonator, the TM mode dielectric resonator is fixed within the metal resonant cavity through the screw, it is characterized in that, a screw rod part of the screw passes through a location hole of the TM mode dielectric resonator to be screwed down on the bottom or side wall of the metal resonant cavity, the screw rod part of the screw is not in contact with a hole wall of the above location hole, and a transition gasket is set between the head of the screw and the end face of the location hole of the TM mode dielectric resonator to separate them. The assembly technology is complicated in the specific implementation process of the patent, which has higher requirements on structure design, exerts greater impact on the performance, goes against volume production, and has high costs.

SUMMARY

In order to solve the above technical defect, the present document provides a dielectric resonator and an assembly method thereof and a dielectric filter, which can guarantee a good close contact between dielectric resonant cylinders and a metal cavity, thereby improving resonant performance of the dielectric filter.

In order to achieve the above object, the following technical scheme is used in the present document.

A dielectric resonator comprises: two dielectric resonant cylinders and a metal cavity, wherein the dielectric resonant cylinders are located within the metal cavity; and further comprises: a fastener and a connector, wherein bottoms of the dielectric resonant cylinders are connected via the connector to form a U-shaped structure, and the connector is fixed on the metal cavity via the fastener.

Preferably, the fastener is a metal fastener, and a first metal layer is plated or a conductive gasket is set on a surface in contact with the metal fastener on the U-shaped structure.

Preferably, the fastener is a non-metal fastener, and a second metal layer is plated on a surface in contact with the metal cavity on the U-shaped structure.

Preferably, the U-shaped structure is a unibody structure or a non-unibody structure.

Preferably, the fastener is a fastening screw, and the connector is a connecting piece.

A dielectric filter, formed by connecting at least two dielectric resonators mentioned above.

An assembly method for a dielectric resonator, comprises:

connecting bottoms of dielectric resonant cylinders via a connector to form a U-shaped structure; and fixing the connector on a metal cavity via a fastener.

Preferably, the fastener is a metal fastener, and a first metal layer is plated or a conductive gasket is set on a surface in contact with the metal fastener on the U-shaped structure.

Preferably, the fastener is a non-metal fastener, and a second metal layer is plated on a surface in contact with the metal cavity on the U-shaped structure.

Preferably, the U-shaped structure is set as a unibody structure or a non-unibody structure.

In the embodiments of the present document, since the above technical scheme is adopted, the following advantages are included: by fixing the dielectric resonant cylinders at the bottom of the metal cavity via the fastener, a good contact between the dielectric resonator and the metal cavity is guaranteed, even though the metal cavity is in the external force or transportation process, a good contact can be guaranteed at any time, thus the performance and reliability of the dielectric resonator and dielectric filter are improved, and the production technology is simple.

BRIEF DESCRIPTION OF DRAWINGS

Here, the described accompanying drawings are used to provide a further understanding of the present document and constitute a part of the present document. The exemplary embodiments and illustrations thereof of the present document are used to explain the present document, but do not constitute a limitation on the present document. In the drawings.

PREFERRED EMBODIMENTS OF THE INVENTION

The present document will be further elaborated in combination with the accompanying drawings and specific embodiments below. It should be noted that the embodiments in the present document and the various ways in the embodiments can be combined with each other in the condition of no conflict.

Figure 1:
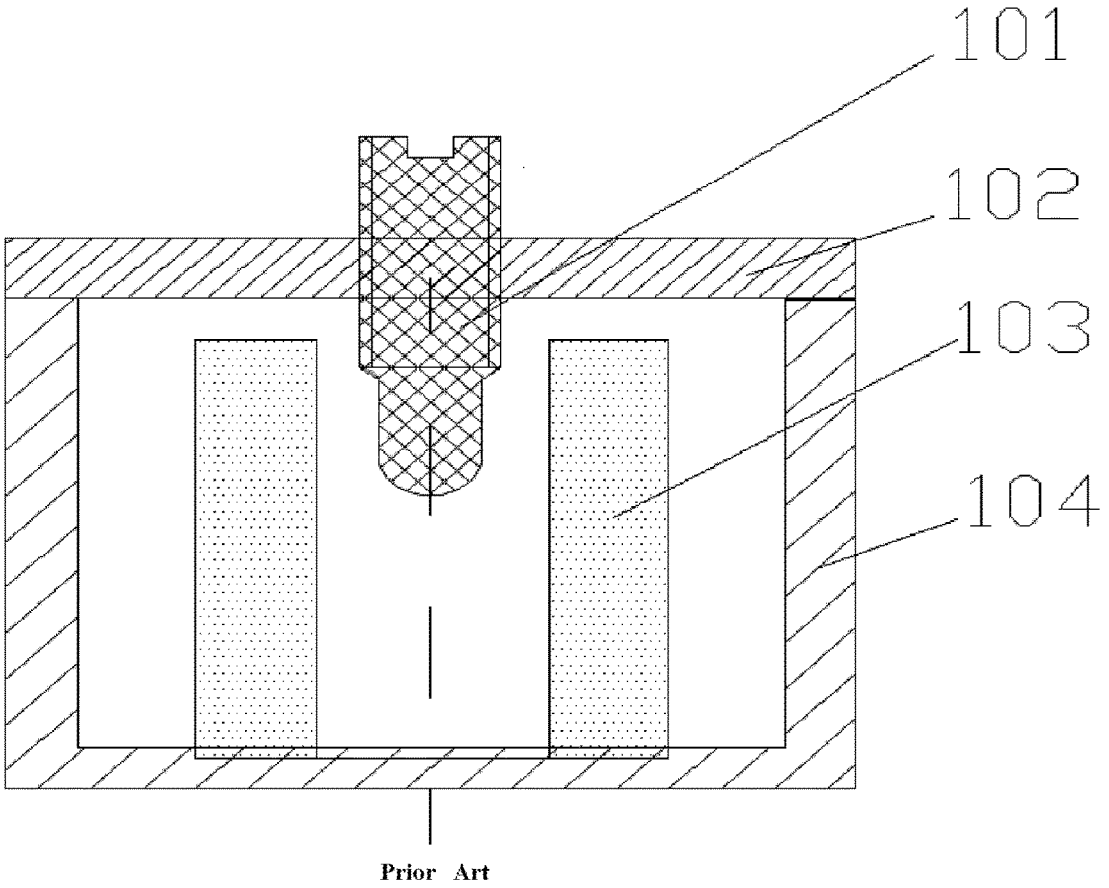
FIG. 1 is a schematic diagram of a structure of the dielectric resonator in the related art.
Figure 2:
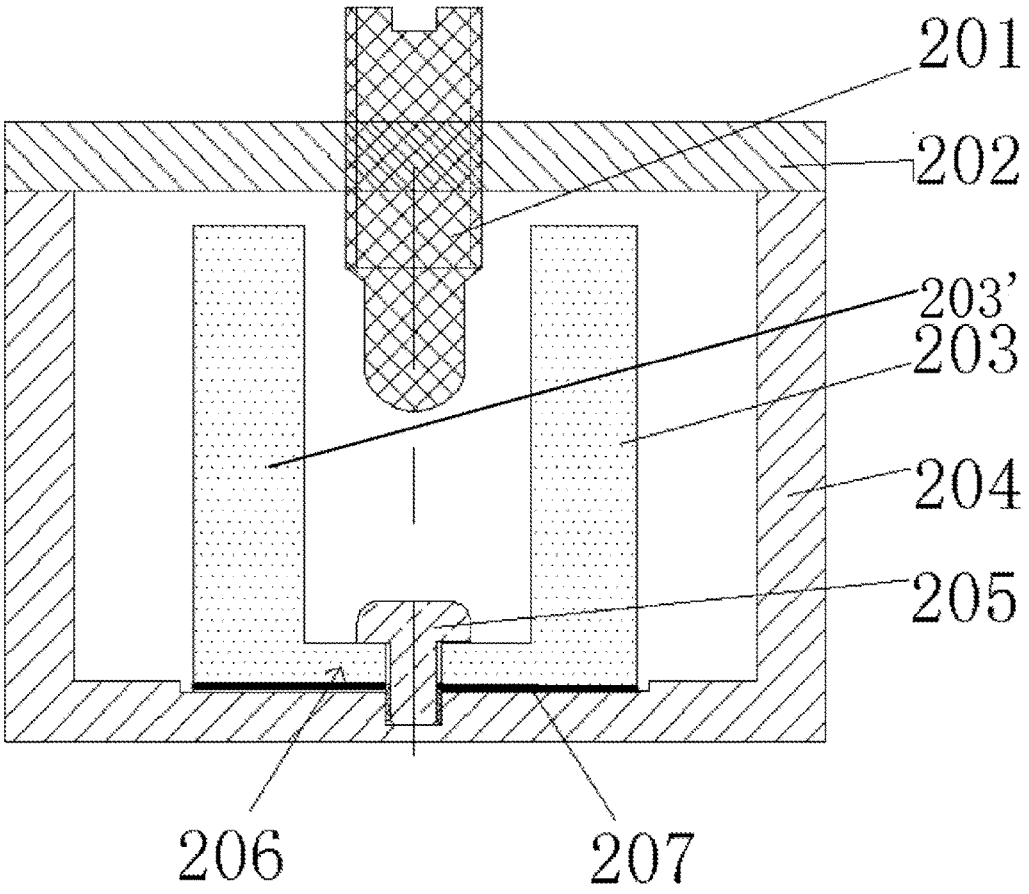
FIG. 2 is a schematic diagram of a structure of a dielectric resonator according to the embodiment 1 of the present document.

As shown in FIG. 2, a dielectric resonator according to the embodiment 1 of the present document is provided, and it includes:

dielectric resonant cylinders 203, 203', a sealing cover plate 202, a tuning screw 201, a metal cavity 204 and a fastening screw 205, bottoms of two dielectric resonant cylinders 203, 203' are connected via a connector 206 to form a U-shaped structure, the dielectric resonant cylinders 203 are located within the metal cavity 204, the fastening screw 205 is a non-metal fastener, a metal layer 207 is plated on a surface in contact with the metal cavity 204 on the U-shaped structure, and the metal layer 207 can be arbitrary metal materials during the implementation, which is used for ensuring the electromagnetic wave transmission between the dielectric resonant cylinders 203, 203' and the metal cavity 204. Wherein, the U-shaped structure formed by connecting the bottoms of the two dielectric resonant cylinders 203, 203' via the connector 206 can be a unibody structure or a non-unibody structure.

The sealing cover plate 202 is located at the upper end face, namely the top, of the metal cavity 204, which is used for sealing the metal cavity 204. The tuning screw 201 is located on the sealing cover plate 202, which is used for adjusting the frequency of the resonator. A groove is set at the bottom within the metal cavity 204. In another embodiment, as shown in FIG. 3, no groove is set at the bottom within the metal cavity 204.

The fastening screw 205 passes through a through-hole on the U-shaped structure, a threaded portion of the fastening screw 205 is fixed at the bottom of the metal cavity 204, which is used for guaranteeing a close contact between the metal cavity 204 and the U-shaped structure, and ensuring the fixation and reliability of the dielectric resonant cavity.

In one implementation process, an assembly process for the dielectric resonator can include but is not limited to the following steps: first the bottoms of two dielectric resonant cylinders 203, 203' are connected via the connector 206 to form a U-shaped structure, a through-hole is set on the U-shaped structure, the fastening screw 205 is a non-metal fastener, the metal layer 207 is plated on the surface in contact with the metal cavity 204 on the U-shaped structure, then the U-shaped structure is placed in the groove at the bottom within the metal cavity 204, the fastening screw 205 passes through the through-hole to fix the connector 206 on the metal cavity 204, then the sealing cover plate 202 is fixed to seal the metal cavity 204, and the tuning screw 201 is assembled on the sealing cover plate 202. After the entire assembly process is finished, the dielectric resonator is tightly fixed within the metal cavity 204, to form a hermetic resonant cavity.

Figure 3:
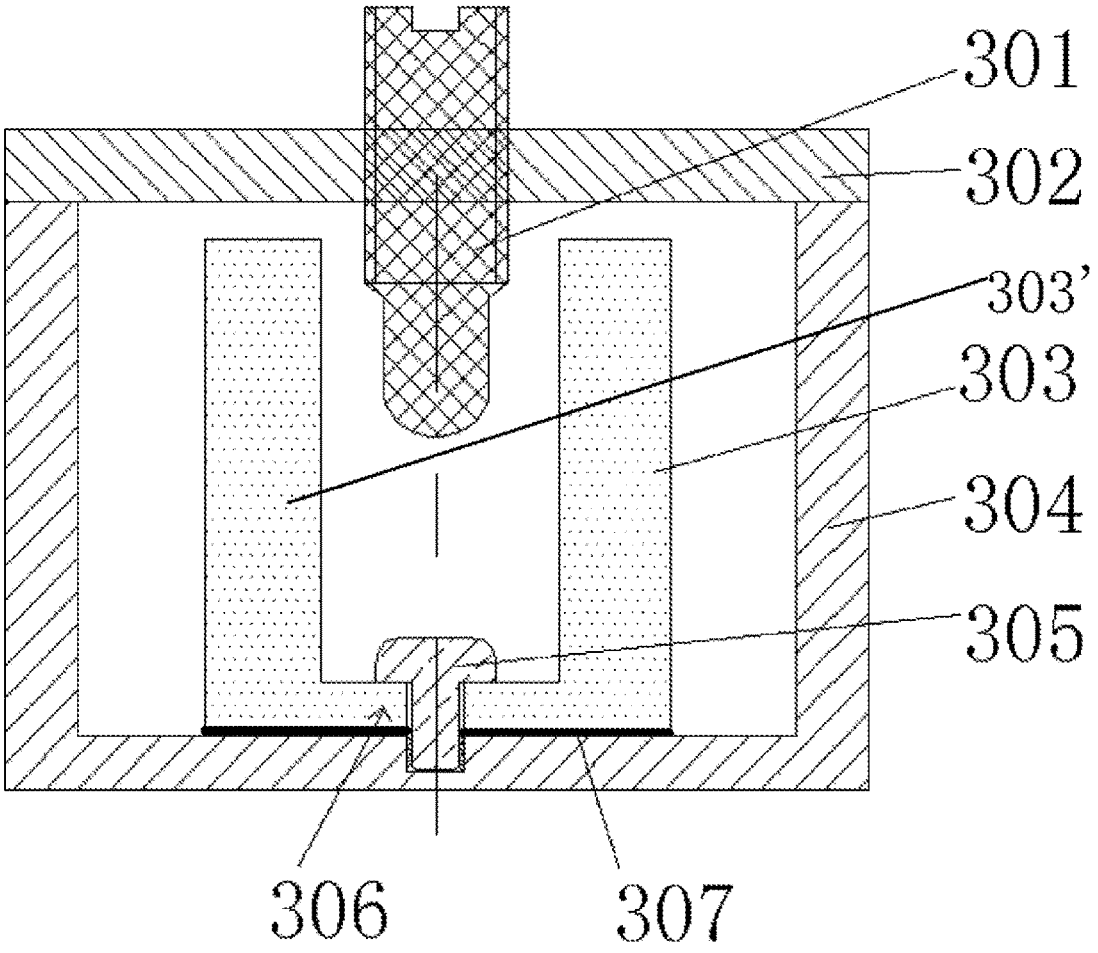
FIG. 3 is a schematic diagram of a structure of a dielectric resonator according to the embodiment 2 of the present document.

As shown in FIG. 3, a dielectric resonator according to the embodiment 2 of the present document is provided, and it includes: dielectric resonant cylinders 303, 303', a sealing cover plate 302, a tuning screw 301, a metal cavity 304 and a fastening screw 305, bottoms of two dielectric resonant cylinders 303, 303' are connected via a connector 306 to form a U-shaped structure, the dielectric resonant cylinders 303 are located within the metal cavity 304, the fastening screw 305 is a non-metal fastener, a metal layer 307 is plated on a surface in contact with the metal cavity 304 on the U-shaped structure, and the metal layer 307 can be arbitrary metal materials during the implementation, which is used for ensuring the electromagnetic wave transmission between the dielectric resonant cylinders 303, 303' and the metal cavity 304. Wherein, the U-shaped structure formed by connecting the bottoms of the two dielectric resonant cylinders 303, 303' via the connector 306 can be a unibody structure or a non-unibody structure.

In another assembly implementation process, as shown in FIG. 3, a connector 306 and a metal layer 307 are included, if there is no groove at the bottom within the metal cavity 304, the U-shaped structure is placed at the bottom within the metal cavity 304.

After the assembly of the U-shaped structure is finished, the lower surface of the U-shaped structure is completely lower than the metal faces of the dielectric resonant cylinders, and according to an electromagnetic field theory, this is more beneficial to propagation of the electric field within the medium.

Figure 4:
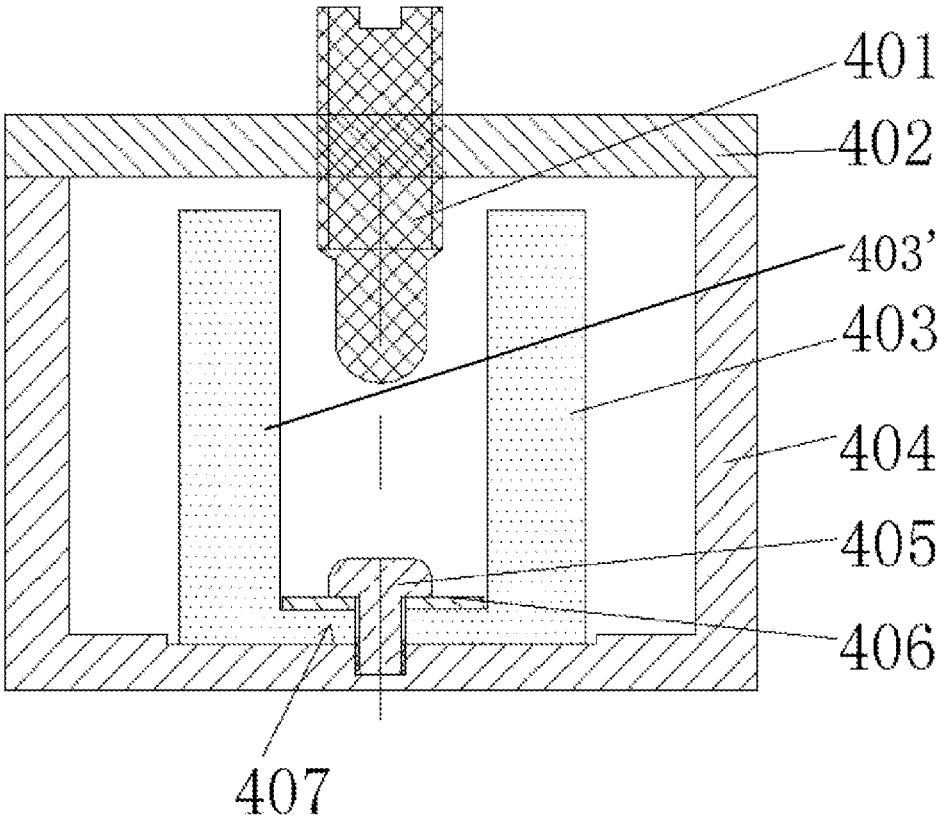
FIG. 4 is a schematic diagram of a structure of a dielectric resonator according to the embodiment 3 of the present document.

FIG. 4 is a schematic diagram of a structure of a dielectric resonator according to the embodiment 3 of the present document. As shown in FIG. 4, the dielectric resonator includes dielectric resonant cylinders 403, 403', a sealing cover plate 402, a tuning screw 401, a metal cavity 404, a fastening screw 405 and a conductive gasket 406, bottoms of two dielectric resonant cylinders 403, 403' are connected via a connector to form a U-shaped structure.

Wherein, the dielectric resonant cylinders 403, 403' are located within the metal cavity 404, the sealing cover plate 402 is located at the upper end face, namely the top, of the metal cavity 404, and it is used for sealing the metal cavity 404, the fastening screw 405 is a metal fastener, a metal layer can be plated or the conductive gasket 406 can be set on a surface in contact with the metal fastening screw 405 on the U-shaped structure, the metal layer can be arbitrary metal materials during the implementation, and the conductive gasket 406 is set in the embodiment, which is used for ensuring the electromagnetic wave transmission between the dielectric resonant cylinders 403, 403' and the metal cavity 404. Wherein, the U-shaped structure formed by connecting the bottoms of the two dielectric resonant cylinders 403, 403' via the connector can be a unibody structure or a non-unibody structure, the dielectric resonant cylinders 403, 403' can be metal and ceramic and so on, the connector also can be metal and ceramic and so on, and the connector can be a flaky connecting piece or a connector in other forms.

The fastening screw 405 passes through a through-hole on the U-shaped structure, a threaded portion of the fastening screw 405 is fixed at the bottom of the metal cavity 404, the electromagnetic field is transmitted to the bottom surface within the metal cavity 404 via the conductive gasket 406 and the fastening screw 405, so as to guarantee a close contact between the conductive gasket 406 and the dielectric resonant cylinders 403, 403', and ensure the fixation and reliability of the dielectric resonant cavity.

In one implementation process, an assembly process for the dielectric resonator can include but is not limited to the following steps: first the bottoms of two dielectric resonant cylinders 403, 403' are connected via the connector to form a U-shaped structure, a through-hole is set on the U-shaped structure, the fastening screw 405 is a metal fastener, a metal layer is plated or the conductive gasket 406 is set on the surface in contact with the metal fastening screw 405 on the U-shaped structure, the metal layer can be arbitrary metal materials during the implementation, then the U-shaped structure is placed in the groove at the bottom within the metal cavity 404, and the fastening screw 405 passes through the through-hole to fix a connector 407 in the groove at the bottom within the metal cavity 404, then the sealing cover plate 402 is fixed to seal the metal cavity 404, and the tuning screw 401 is assembled on the sealing cover plate 402. After the entire assembly process is finished, the dielectric resonator is tightly fixed within the metal cavity 404, to form a hermetic resonant cavity.

In another assembly implementation process, if there is no groove at the bottom within the metal cavity 404, the U-shaped structure is placed at the bottom within the metal cavity 404.

The present document also provides a dielectric filter, the dielectric filter includes a plurality of dielectric resonators as mentioned in the above embodiments, the dielectric filter is a multi-order dielectric filter formed by connecting multiple dielectric resonators mentioned above according to any connection modes.

The above embodiments are only the preferred embodiments of the present document, which are not used to limit the protection scope of the present document, and the skilled in the art can deliberately make various modifications and variations for the present document without departing from the spirit and scope of the present document. Therefore, if these modifications and variations of the present document belong to the scope of the claims of the present document and the equivalent techniques thereof, the present document also intends to include these modifications and variations.

INDUSTRIAL APPLICABILITY

In the embodiments of the present document, since the above technical scheme is adopted, the following advantages are included: by fixing the dielectric resonant cylinders at the bottom of the metal cavity via the fastener, a good contact between the dielectric resonator and the metal cavity is guaranteed, even though the metal cavity is in the external force or transportation process, a good contact can be guaranteed at any time, thus the performance and reliability of the dielectric resonator and dielectric filter are improved, and the production technology is simple.

What is claimed is:

1. A dielectric resonator, comprising: two dielectric resonant cylinders and a metal cavity, wherein the two dielectric resonant cylinders are located within the metal cavity; and further comprising:

a fastener and a connector, wherein bottoms of the dielectric resonant cylinders are connected via the connector to form a U-shaped structure, and the connector is fixed on the bottom of the metal cavity via the fastener.

2. The dielectric resonator according to claim 1, wherein, the fastener is a metal fastener, and a first metal layer is plated or a conductive gasket is set on a surface of the connector of the U-shaped structure and is in contact with the metal fastener.

3. The dielectric resonator according to claim 1, wherein, the fastener is a non-metal fastener, and a second metal layer is plated on a surface of the connector of the U-shaped structure and is in contact with the non-metal fastener.

4. The dielectric resonator according to claim 1, wherein, the U-shaped structure is a unibody structure or a non-unibody structure.

5. The dielectric resonator according to claim 1, wherein, the fastener is a fastening screw, and the connector is a connecting piece.

6. A dielectric filter, formed by connecting at least two dielectric resonators according to claim 1.

7. The dielectric resonator according to claim 2, wherein, the U-shaped structure is a unibody structure or a non-unibody structure.

8. The dielectric resonator according to claim 3, wherein, the U-shaped structure is a unibody structure or a non-unibody structure.

9. The dielectric resonator according to claim 2, wherein, the fastener is a fastening screw, and the connector is a connecting piece.

10. The dielectric resonator according to claim 3, wherein, the fastener is a fastening screw, and the connector is a connecting piece.

11. An assembly method for a dielectric resonator, comprising:

connecting bottoms of dielectric resonant cylinders via a connector to form a U-shaped structure; and fixing the connector on the bottom of a metal cavity via a fastener.

12. The method according to claim 11, wherein, the fastener is a metal fastener, and a first metal layer is plated or a conductive gasket is set on a surface of the connector of the U-shaped structure and is in contact with the metal fastener.

13. The method according to claim 11, wherein, the fastener is a non-metal fastener, and a second metal layer is plated on a surface of the connector of the U-shaped structure and is in contact with the non-metal fastener.

14. The method according to claim 11, wherein, the U-shaped structure is set as a unibody structure or a non-unibody structure.

15. The method according to claim 12, wherein, the U-shaped structure is set as a unibody structure or a non-unibody structure.

16. The method according to claim 13, wherein, the U-shaped structure is set as a unibody structure or a non-unibody structure.

* * * * *